US007229259B2

(12) United States Patent
Nieter

(10) Patent No.: US 7,229,259 B2
(45) Date of Patent: Jun. 12, 2007

(54) COMPRESSOR MOTOR-END BEARING HAVING OIL LEAKAGE PATH

(75) Inventor: Jeffrey J. Nieter, Coventry, CT (US)

(73) Assignee: Carrier Corporation, Syracuse, NY (US)

( * ) Notice: Subject to any disclaimer, the term of this patent is extended or adjusted under 35 U.S.C. 154(b) by 567 days.

(21) Appl. No.: 10/728,309

(22) Filed: Dec. 4, 2003

(65) Prior Publication Data

US 2005/0123421 A1 Jun. 9, 2005

(51) Int. Cl.
*F04B 17/00* (2006.01)

(52) U.S. Cl. ..... 417/371; 417/366

(58) Field of Classification Search ..... 417/415, 417/366, 371; 184/6.5, 6.6; 384/322, 397, 384/398, 399

See application file for complete search history.

(56) References Cited

U.S. PATENT DOCUMENTS 6,386,840 B1 * 5/2002 Williams et al. ..... 417/371

* cited by examiner

*Primary Examiner*—Anthony Stashick
*Assistant Examiner*—Vikansha Dwivedi
(74) *Attorney, Agent, or Firm*—Carlson, Gaskey & Olds

(57) ABSTRACT

A compressor includes a motor having a rotor for driving a shaft, to drive compressor pistons. A lubricant supply system supplies lubrication to the moving elements within the compressor and motor. A suction fluid to be compressed passes over the motor on its way to the compression chambers. The oil is returned from a bearing mounting an end of the shaft intermediate the motor rotor and the compressor pistons. The bearing mount ensures that the lubricant is returned away from the motor rotor, to reduce the amount of oil that is entrained in the fluid to be compressed.

11 Claims, 2 Drawing Sheets

COMPRESSOR MOTOR-END BEARING HAVING OIL LEAKAGE PATH

BACKGROUND OF THE INVENTION

This application relates to a compressor having fluid flow passing over a motor, and having an oil leakage path for directing oil away from the path of the fluid on its way to the compression chamber(s).

Compressors are known having a motor chamber sealed from the environment and having the working fluid passing through it. In one common type of such compressor, the fluid to be compressed, or working fluid, passes over the motor on its way to the compression chamber(s), cooling the motor. Such compressors often have shaft bearings lubricated by oil. Typically, the motor chamber ends in a bearing mount receiving a motor-end bearing. Lubricant is directed to the motor-end bearing, and can leak outwardly of the bearing at each end. When the lubricant leaks outwardly of the end of the bearing spaced toward the motor, it comes into contact with the motor rotor, which is rotating. The motor rotor throws a portion of this lubricant into the flow of fluid heading toward the compression chamber(s). This brings an undesirably high amount of lubricant into a compression chamber along with the fluid to be compressed.

SUMMARY OF THE INVENTION

In the disclosed embodiment of this invention, the motor-end bearing and its mount are provided with a leakage path to drain the lubricant away from the end of the bearing adjacent the motor rotor. Instead, the lubricant received within the motor-end bearing is directed to an opposed side of the bearing, and away from the rotating rotor. Thus, less lubricant is thrown into the path of the fluid leading to the compression chamber(s), and less lubricant is entrained with the fluid to be compressed.

In preferred embodiments of this invention, the relief passages include a passage extending through the bearing mount, and to an opposed end of the bearing mount remote from the motor rotor. Various arrangements of washers, seals and relief passages are disclosed in several embodiments.

These and other features of the present invention can be best understood from the following specification and drawings, the following of which is a brief description.

DETAILED DESCRIPTION OF THE PREFERRED EMBODIMENT

Figure 1:
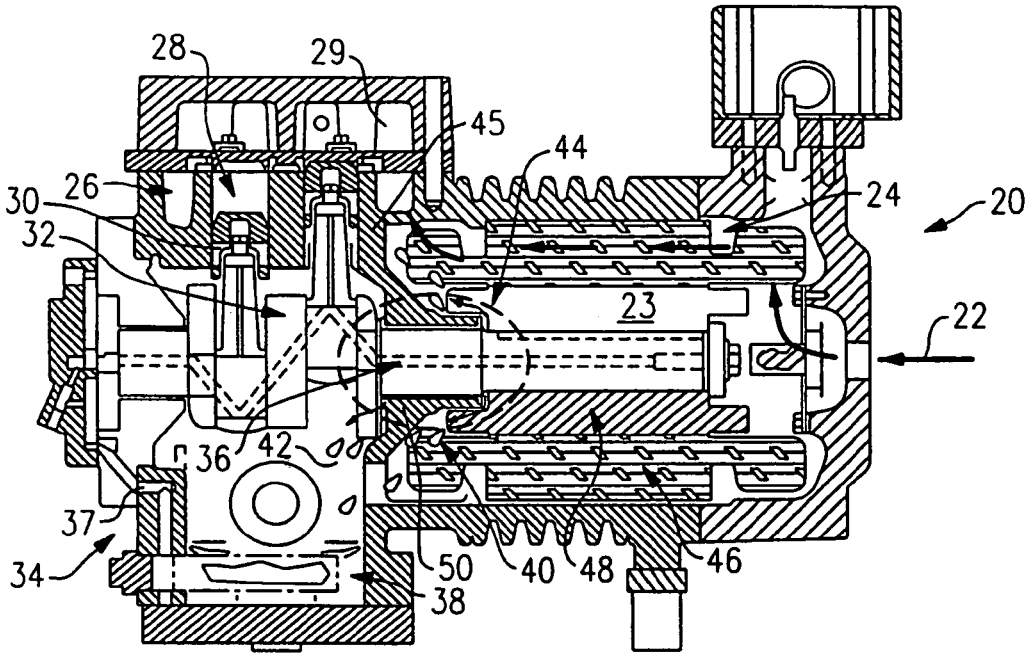
FIG.1 Prior Art
FIG. 1 is a cross-sectional view of a prior art motor and compressor assembly.

FIG. 1 shows a compressor and motor arrangement 20 having an inlet flow path 22 entering a sealed motor chamber 23. As shown, the fluid to be compressed passes over the motor stator at 24 through passages, as known. A suction plenum 26 communicates with compression chambers 28 having pistons 30. Thus, the fluid to be compressed passes into inlet 22, along path 24, into suction plenum 26, and then into chambers 28. This fluid is compressed and passes outwardly through an exit port 29. As also shown, a shaft 32 drives the pistons 30 for reciprocation within their respective chambers 28. A housing 34 for receiving the pistons includes an oil sump at 38. As is known, an oil pump and passage arrangement 37 moves lubricant from the sump 38 into a path 36 within the shaft 32. Lubricant is delivered along the length of the shaft 32. Although this invention has been disclosed for a reciprocating piston type compressor, it would also apply to compressors of other types having an enclosed motor chamber.

As shown at 40, 42, and 44, a bearing 50 adjacent to the motor has lubricant being returned outwardly in several directions. The bearing 50 is mounted in bearing mount 45. The motor rotor 48 is rotating in the vicinity of the returned lubricant at 40 and 44. This lubricant may thus be thrown upwardly and potentially into the path 24 of the fluid leading to the plenum 26. Thus, with the prior art, an undesirably high amount of lubricant may be entrained within the fluid to be compressed.

Figure 2:
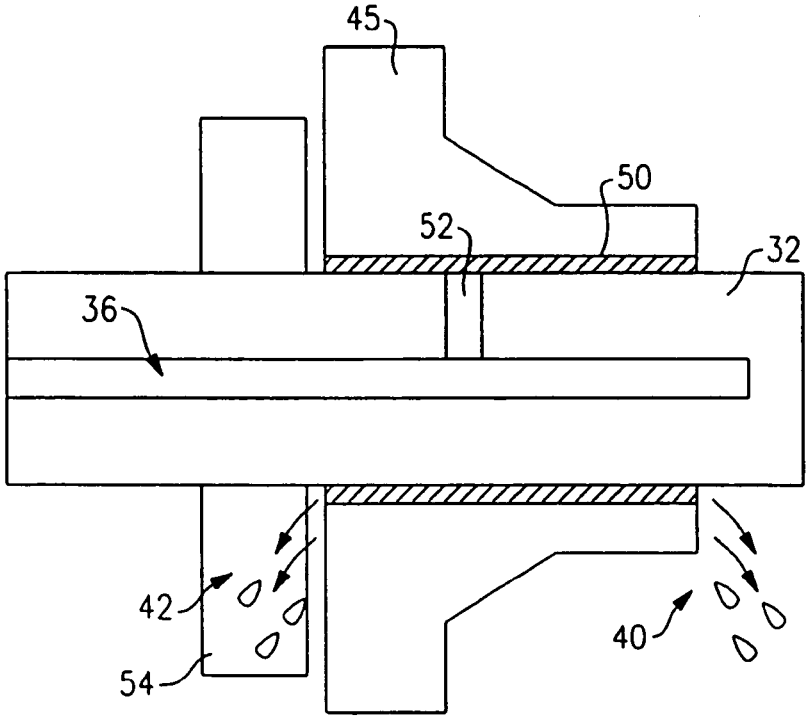
FIG.2 Prior Art
FIG. 2 shows a prior art bearing mount for the compressor of FIG. 1.

As shown in FIG. 2, the prior art has this problem due to the fact that the oil path 36 extends to an oil supply line 52 for supplying oil to the bearing 50. As mentioned above, a bearing mount 45 mounts the bearing 50. Lubricant is thrown outwardly of the bearing ends as shown at 40 and 42. In particular, the lubricant 40 would come into contact with the rotating rotor 48, which would throw the lubricant upwardly.

Figure 3:
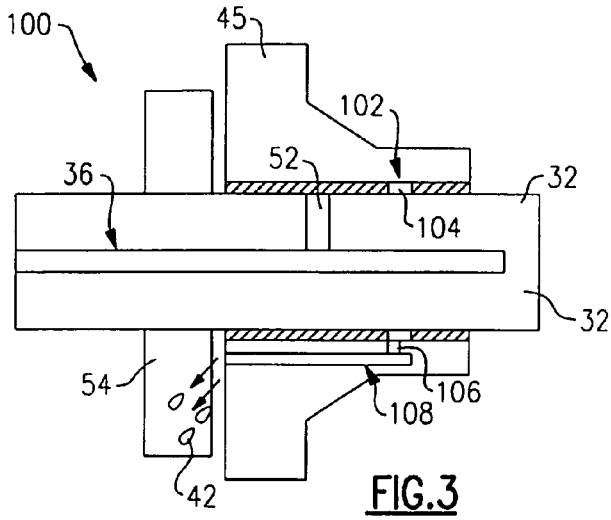
FIG. 3 shows a first embodiment inventive bearing mount for the compressor and motor of FIG. 1.

One embodiment 100 of the present invention is shown in FIG. 3. In embodiment 100, the shaft 32 is structured essentially similar to the prior art. However, the bearing 102 has an opening 104 to assist the flow of lubricant outwardly to a tap 106 leading to a drain passage 108. Notably, drain passage 108 extends to the remote end of the bearing mount 45 from that which is adjacent the motor. Thus, leakage lubricant will pass from the passage 52, through the opening 104, into the tap 106, and to the drain passage 108. This lubricant will thus be returned as shown at 42. Significantly less lubricant is directed out of the other end, thus reducing the amount of lubricant that is thrown into the path of the fluid to be compressed.

Figure 4:
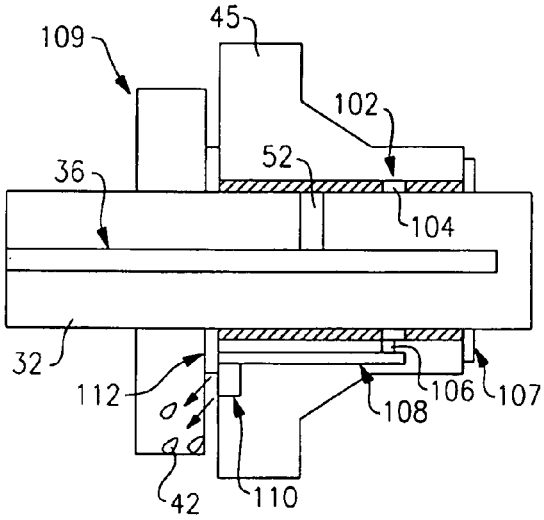
FIG. 4 shows a second embodiment.

FIG. 4 shows another embodiment 109. In embodiment 109, the bearing 102 has a similar passage 104 as the prior embodiment, and a similar tap and relief passage 106 and 108. There is an oil retaining seal 107, further preventing the flow of lubricant to the end of the bearing 102 that is adjacent to the motor rotor. Further, there is a thrust washer 112 associated with the opposed side of the bearing mount 45. A relief 110 communicates with an end 108 of the drain passage, again to assist the flow of the lubricant to the remote side of the bearing mount 45, and away from the shaft 32.

Figure 5:
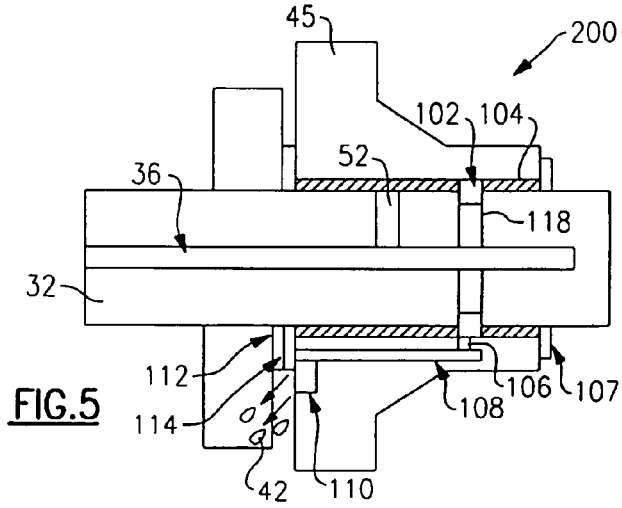
FIG. 5 shows a third embodiment.

FIG. 5 shows yet another embodiment 200. In embodiment 200, the bearing 102 has a similar passage 104 as the prior embodiments, and a similar tap and relief passage 106 and 108. In addition, there is groove 118 in shaft 32 to enhance flow of lubricant leading to the tap 106. In this embodiment, there is again the passage 108 and the relief 110. However, the thrust washer 112 is provided with an oil drain cutout 114 on the side adjacent to the relief 110, again to assist the desired flow of lubricant to the sump.

In sum, the present invention discloses a number of bearing mounts that assist the flow of lubricant to a remote end of a motor-end bearing in a sealed compressor. This reduces the amount of lubricant that is entrained in the fluid to be compressed. Thus, problems such as discussed in the Background of the Invention section of this application are reduced.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A compressor comprising:

an electric motor having a stator and a rotor, said rotor driving a shaft for rotation, and said motor being mounted in a motor chamber, said motor chamber including a suction inlet for receiving a fluid to be compressed, such suction inlet passing the fluid to be compressed over said motor to cool said motor;

a compressor housing, said compressor housing being mounted adjacent to said motor chamber, said compressor housing including a compressor pump unit driven by said shaft to compress a fluid, and said compressor pump unit including a chamber for receiving refrigerant from said motor chamber to be compressed by said compressor pump unit, said compressor pump unit including reciprocating pistons movable within said chambers, a lubricant supply system included for supplying a lubricant to said shaft said shaft including a bearing mounted at an end of said motor rotor adjacent to said compressor housing, and a mount for said bearing, a lubricant supply for supplying lubricant to a location on the shaft remote from the motor, and lubricant flowing along a passage on the shaft toward the motor, said mount including an oil return passage for returning lubricant from said bearing toward an end of said bearing spaced away from said motor;

said compressor housing separated from said motor housing by said mount, said mount including drain passages for guiding a returned lubricant away from said motor rotor; and said bearing provided with a notch for supplying lubricant through said bearing to said mount, said mount being provided with a drain passage for directing lubricant to said end of said bearing remote from said motor rotor.

2. A compressor as set forth in claim 1, wherein a notch is formed in said mount at an end of said drain passage remote from said motor rotor, said notch being formed in an end face of said mount, and further assisting the flow of lubricant away from said motor rotor.

3. A compressor as set forth in claim 2, wherein a thrust bearing is positioned at an end of said mount adjacent to said notch.

4. A compressor as set forth in claim 3, wherein said thrust bearing is provided with a notch, said thrust bearing notch cooperating with said mount notch to further ensure lubricant is supplied to said second end of said bearing.

5. A compressor as set forth in claim 1, wherein an oil seal is positioned at a second end of said bearing spaced towards said motor.

6. A compressor comprising:

an electric motor having a stator and a rotor, said rotor driving a shaft for rotation, and said motor being mounted in a sealed chamber, said chamber including a suction inlet for receiving a fluid to be compressed, such suction inlet passing said fluid to be compressed over said motor to cool said motor;

a compressor housing, said compressor housing being mounted adjacent to said motor housing, said compressor housing including a compressor pump unit with reciprocating pistons driven by said shaft to compress a fluid, and said compressor housing including a suction plenum for receiving refrigerant from said motor chamber for delivery to chambers associated with said pistons; and a lubricant supply for supplying lubricant to said shaft, said shaft including a bearing mounted at an end of said motor rotor adjacent to said compressor housing, such that said bearing is intermediate said compressor pump unit and said motor rotor, and a mount for said bearing, the lubricant supply for supplying lubricant to a location on the shaft remote from the motor, and lubricant flowing along a passage on the shaft toward the motor, said mount including an oil return passage for returning lubricant from said bearing towards an end of said bearing spaced away from said motor, said compressor housing separated from said motor housing by said mount, said mount including drain passages for guiding returned lubricant away from said motor rotor; said bearing is provided with a notch for supplying lubricant through said bearing to said mount, said mount being provided with a drain passage for directing lubricant to said end of said bearing remote from said motor rotor.

7. A compressor as set forth in claim 6, wherein a notch is formed in said mount at an end of said drain passage remote from said motor rotor, said notch being formed in an end face of said mount, and further assisting the flow of lubricant away from said motor rotor.

8. A compressor as set forth in claim 7, wherein a thrust bearing is positioned at an end of said mount adjacent to said notch.

9. A compressor as set forth in claim 8, wherein said thrust bearing is provided with a notch, said thrust bearing notch cooperating with said mount notch to further ensure lubricant is supplied to said second end of said bearing.

10. A compressor as set forth in claim 6, wherein an oil seal is positioned at a second end of said bearing spaced towards said motor.

11. A compressor as set forth in claim 1, wherein the lubricant supply includes a lubricant pump for directing lubricant to an end of said shaft remote from said motor, the lubricant passing along a passage within said shaft toward said motor, and exiting the shaft to lubricate said bearing.

* * * * *